US007279231B2

(12) United States Patent
Chebiam et al.

(10) Patent No.: US 7,279,231 B2
(45) Date of Patent: Oct. 9, 2007

(54) ELECTROLESS PLATING STRUCTURE

(75) Inventors: Ramanan V. Chebiam, Hillsboro, OR (US); Valery M. Dubin, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/649,087

(22) Filed: Aug. 26, 2003

(65) Prior Publication Data

US 2004/0038073 A1 Feb. 26, 2004

Related U.S. Application Data

(62) Division of application No. 10/025,033, filed on Dec. 19, 2001, now Pat. No. 6,645,567.

(51) Int. Cl.

| | |
|---|---|
| ***B32B 15/04*** | (2006.01) |
| ***B32B 15/20*** | (2006.01) |
| ***H01L 21/445*** | (2006.01) |
| ***H01L 29/43*** | (2006.01) |

(52) U.S. Cl. ..... 428/674; 428/675; 428/704; 438/648; 438/650; 438/666; 438/678; 438/687; 257/762; 257/763

(58) Field of Classification Search ..... 257/758, 257/762, 763, 761, 764, 765, 766; 438/612, 438/622, 648, 650, 652, 656, 666, 678, 685, 438/686, 687; 428/674, 675, 671, 620, 704
See application file for complete search history.

(56) References Cited

U.S. PATENT DOCUMENTS

| | | | | |
|---|---|---|---|---|
| 4,600,609 | A | 7/1986 | Leever et al. | |
| 4,893,404 | A * | 1/1990 | Shirahata et al. | 29/852 |
| 5,203,911 | A | 4/1993 | Sricharoenchaikit et al. | |
| 5,562,760 | A | 10/1996 | Ballard et al. | |
| 5,645,628 | A | 7/1997 | Endo et al. | |
| 5,695,810 | A | 12/1997 | Dubin et al. | |
| 5,718,745 | A | 2/1998 | Itoh et al. | |
| 5,755,859 | A | 5/1998 | Brusic et al. | |
| 5,897,965 | A | 4/1999 | Itoh et al. | |
| 6,016,000 | A * | 1/2000 | Moslehi | 257/522 |
| 6,183,545 | B1 | 2/2001 | Okuhama et al. | |
| 6,235,093 | B1 | 5/2001 | Okuhama et al. | |
| 6,335,104 | B1 * | 1/2002 | Sambucetti et al. | 428/615 |
| 6,455,175 | B1 | 9/2002 | Kozlov et al. | |
| 6,717,189 | B2 | 4/2004 | Inoue et al. | |
| 2002/0121709 | A1 * | 9/2002 | Matsuki et al. | 257/786 |
| 2002/0185658 | A1 | 12/2002 | Inoue et al. | |
| 2004/0038073 | A1 | 2/2004 | Chebiam et al. | |

FOREIGN PATENT DOCUMENTS

EP 0 073 583 A1 3/1983

OTHER PUBLICATIONS

Derwent abstract of JP61/186275, Aug. 1986, 3 pages.

* cited by examiner

*Primary Examiner*—Michael E. Lavilla
(74) *Attorney, Agent, or Firm*—Blakely, Sokoloff, Taylor & Zafman LLP

(57) ABSTRACT

The present invention relates to a cobalt electroless plating bath composition. In one embodiment, the present invention relates to cobalt electroless plating in the fabrication of interconnect structures in semiconductor devices.

9 Claims, 2 Drawing Sheets

ELECTROLESS PLATING STRUCTURE

The present patent application is a divisional of Ser. No. 10/025,033, now U.S. Pat. No. 6,645,567, filed Dec. 19, 2001, and issued Nov. 11, 2003.

FIELD OF THE INVENTION

The present invention relates generally to electroless plating. More particularly, the present invention relates to back-end-of-line (BEOL) microelectronic device fabrication. In one particular embodiment, the present invention relates to cobalt electroless plating in the fabrication of interconnect structures in semiconductor devices.

DESCRIPTION OF RELATED ART

Cobalt electroless processes have been used in the semiconductor industry. Miniaturization is the process of reducing the size of semiconductor devices, while crowding more devices onto a relatively smaller area of a substrate. One challenge in electroless plating processes is to keep the process flow simple while still achieving the sometimes complex chemical demands required to accomplish the plating process.

During semiconductor wafer fabrication, multiple levels of conductive layers are formed above a substrate. The multiple metallization layers are employed in order to accommodate higher densities as device dimensions shrink well below one micrometer (micron) design rules. Thus, semiconductor structures having six levels of metallization (the sixth level being referred to as metal-six or M6) or more are becoming more prevalent as device geometries shrink to submicron levels.

One common metal used for forming metal lines, also referred to a metallization or wiring on a wafer is aluminum. Aluminum is used because it is relatively inexpensive compared to other conductive materials, it has low resistivity and is relatively easy to etch. Aluminum is also used as a material for forming interconnections in vias to connect the different metal layers. However, as the size of via/contact holes is scaled down to a sub-micron region, the step coverage becomes a problem. Poor step coverage in the sub-micron via/contact holes results in high current density and makes electromigration worse.

One material which has received considerable attention as a replacement material for VLSI interconnect metallizations is copper. Since copper has better electromigration properties and lower resistivity than aluminum, it is preferred. In addition, copper plugs have more improved electrical properties over tungsten plugs. However, a disadvantage of using copper metallization is that it is difficult to etch. Accordingly, one practice has been to utilize chemical-mechanical polishing (CMP) techniques to polish away the unwanted copper material. Another concern with the use of copper as interconnect material is its diffusion properties. Accordingly, diffusion barrier metals are used, such as titanium nitride (TiN), tantalum nitride (TaN), or titanium tungsten (TiW), as well as dielectric barrier materials, such as silicon nitride (SiN) and silicon carbide (SiC).

To replace the tungsten and aluminum plugs with copper plugs in VLSI or in ultra large-scale integration (ULSI) manufacturing, another important factor to consider is the process cost. The technique of selectively depositing copper within the via holes to form the plugs is attractive, because it eliminates the polishing (CMP) step. One technique of selectively depositing metals, is the use of electroless deposition. In comparison to other deposition techniques, electroless deposition is attractive due to the low processing cost and high quality of metal deposited. However, electroless deposition requires the activation of a surface in order to electrolessly deposit the metal, such as cobalt. Additionally, electroless deposition requires complicated, multi-component chemistries that pose both control and replenishment challenges due to the many and varied components.

BRIEF DESCRIPTION OF THE DRAWINGS

In order to illustrate the manner in which embodiments of the invention are obtained, a more particular description of the invention briefly described above will be rendered by reference to specific embodiments thereof which are illustrated in the appended drawings. Understanding that these drawings depict only typical embodiments of the invention that are not necessarily drawn to scale and are not therefore to be considered to be limiting of its scope, the invention will be described and explained with additional specificity and detail through the use of the accompanying drawings in which.

DETAILED DESCRIPTION OF THE INVENTION

Figure 1:
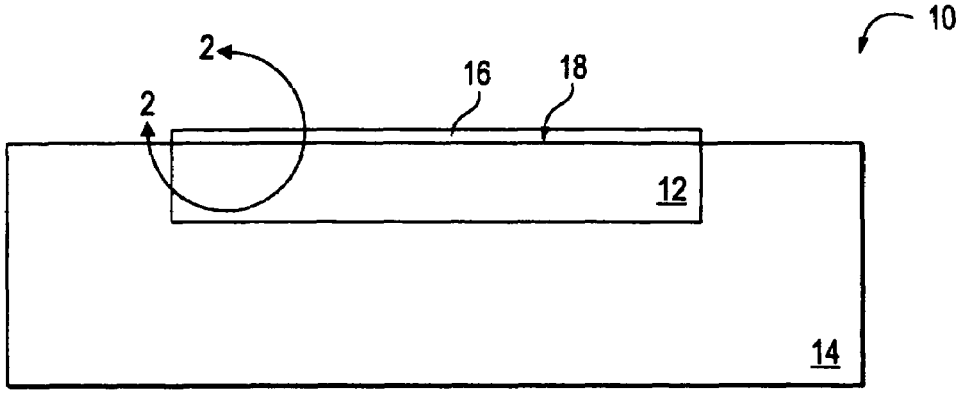
FIG. 1 is an elevational cross-section of a semiconductor structure that depicts an electroless plating structure according to an embodiment.

Electroless plating is a process for depositing onto a surface by chemical reduction in the absence of an external electric current. Electroless plating is a selective deposition and occurs at locations on the surface that may have a nucleation potential for the plating solution. For electroless plating of a metal, one inventive process includes a metal ion, a pH-adjusting agent, a single complexing/buffering agent to maintain the metal in solution, at least one reducing agent, and optionally a wetting agent. In one embodiment, electroless plating is carried out on a metal substrate as depicted in FIG. 1. A semiconductor structure 10 includes a metallization 12 that is disposed in a substrate 14. Metallization 12 is depicted as a metal-six copper (M6 Cu) pad. However, metallization may be other structures such as an interconnect, a metal line, and other electrically conductive structures. A metal film 16 is depicted as being electrolessly plated on the upper surface 18 of metallization 12, according to an embodiment of the present invention.

Metal Constituents

The metal ion may be selected from various metals or combinations thereof. In one embodiment, the metal is selected from at least one primary metal and from zero to at least one secondary metal.

The at least one primary metal is selected from the group of copper (Cu), silver (Ag), gold (Au), and combinations thereof. In one embodiment, the at least one primary metal is selected from the group of nickel (Ni), palladium (Pd), platinum (Pt), and combinations thereof. In one embodiment, the at least one primary metal is selected from the group of cobalt (Co), rhodium (Rh), iridium (Ir), and combinations thereof. In another embodiment, the at least one primary metal is selected from a combination of at least two metals that combine metals from the above-referenced groups. In one embodiment, the primary metal(s) is supplied in a concentration range from about 2 gram/liter to about 50 gram/liter. In another embodiment, the primary metal(s) is supplied in a concentration range from about 5 gram/liter to about 35 gram/liter.

In one embodiment, at least one secondary metal is added to the primary metal(s). In one embodiment, the at least one secondary metal is selected from the group of chromium (Cr), molybdemum (Mo), tungsten (W), and combinations thereof. In another embodiment, the at least one secondary metal is selected from the group of manganese (Mn), technetium (Tc), rhenium (Re), and combinations thereof. In another embodiment, the at least one secondary metal is selected from a combination of at least two metals that combine metals from the above-referenced groups. In one embodiment, the secondary metal(s) is supplied in a concentration range from about 1 gram/liter to about 40 gram/liter. In another embodiment, the secondary metal(s) is supplied in a concentration range from about 2 gram/liter to about 35 gram/liter.

Reducing Agents

Reducing agents are provided to assist in assuring metal deposition as the chemical environment of the substrate onto which the metal deposits continues to change. Although initial deposition of a primary metal onto a substrate may be autocatalytic, the changing chemical environment may interrupt the autocatalytic environment. In one embodiment, where deposition is upon a copper metal-six (Cu M6) pad as known in the art, initial deposition will be achieved in the presence of the Cu M6 pad. Consequently, the copper pad substrate affects the initial, presumably oxidation-reduction (REDOX) deposition chemistry. However, as the Cu M6 pad is covered by way of non-limiting example, by cobalt, the REDOX chemical environment changes from a cobalt-onto-copper plating, to a cobalt-onto-cobalt plating. Accordingly, a reducing agent(s) is provided to assure continued cobalt plating despite the changed substrate environment.

The electroless plating composition is combined with a primary reducing agent in a mixture of solvents. In one embodiment, a primary reducing agent including boron (B) is provided. Primary reducing agents that can be utilized for this application include ammonium, alkali metal, alkaline earth metal borohydrides, and the like, and combinations thereof. In one embodiment, inorganic primary reducing agent embodiments include sodium borohydride, lithium borohydride, zinc borohydride, and the like, and combinations thereof. In one embodiment, an organic primary reducing agent is dimethylaminoborane (DMAB). In another embodiment, other aminoboranes are used such as diethylaminoborane, morpholine borane, combinations thereof, and the like. In one embodiment, the primary reducing agent(s) is supplied in a concentration range from about 1 gram/liter to about 30 gram/liter. In another embodiment, the primary reducing agent(s) is supplied in a concentration range from about 2 gram/liter to about 20 gram/liter.

In one embodiment, a secondary reducing agent is provided to assist the changing chemical environment during deposition of the primary metal and optional secondary metal. In one embodiment a phosphorus-containing compound is selected as the secondary reducing agent. Phosphorus-containing compounds may include hypophosphites. In one embodiment, the hypophosphite is selected from non-alkaline metal hypophosphites such as ammonium hypophosphite and the like.

In one embodiment, the hypophosphite is selected from alkaline metal hypophosphites such as sodium hypophosphite and the like. One embodiment includes an inorganic phosphorus-containing compound such as hypophosphites of lithium, sodium, potassium, and mixtures thereof. One embodiment includes an inorganic phosphorus-containing compound such as hypophosphites of, magnesium, calcium, strontium, and mixtures thereof. One embodiment includes an inorganic phosphorus-containing compound such as nickel hypophosphite and the like. One embodiment includes an inorganic phosphorus-containing compound such as hypophosphorous acid and the like.

Other secondary reducing agents are selected from sulfites, bisulfites, hydrosulfites, metabisulfites, and the like. Other secondary reducing agents are selected from dithionates, and tetrathionates, and the like. Other secondary reducing agents are selected from thiosulfates, thioureas, and the like. Other secondary reducing agents are selected from hydrazines, hydroxylamines, aldehydes, glyoxylic acid, and reducing sugars. In another embodiment, the secondary reducing agent is selected from diisobutylaluminum hydride, sodium bis(2-methoxyethoxy)aluminum hydride, and the like.

In one embodiment, the secondary reducing agent(s) is supplied in a concentration range from about 0 gram/liter to about 5 gram/liter. In another embodiment, the secondary reducing agent(s) is supplied in a concentration range from about 1 gram/liter to about 2 gram/liter.

In one embodiment, the primary reducing agent is DMAB in a concentration range from about 2 gram/liter to about 30 gram/liter, and the secondary reducing agent is ammonium hypophosphite in a concentration range from about 0 gram/liter to about 2 gram/liter. Other embodiments include primary and secondary reducing agents that are substituted for DMAB and ammonium hypophosphite, or one of them, as long as they approximate the gram equivalent amounts of the primary and secondary reducing agents of the DMAB and the ammonium hypophosphite. The gram equivalent amounts may be adjusted by various means, such as according to the comparative dissociation constants of the reducing agents.

The Complexing/Buffering Agent

It was discovered that a single compound could act as a complexing and buffering agent for the inventive electroless plating solution. This simplified the electroless plating process flow including such process parameters as solution replenishment and control. In one embodiment, an organic sulphate salt compound was found to fulfill the requirement. One embodiment includes ammonium sulphate $(NH)_2SO_4$ and the like. Other single-compound complexing and buffering agents may be selected that have an effective gram equivalent amount to the $(NH)_2SO_4$. In one embodiment, the complexing/buffering agent is supplied in a concentration range from about 50 gram/liter to about 1,000 gram/liter. In another embodiment, the complexing/buffering agent is supplied in a concentration range from about 80 gram/liter to about 600 gram/liter.

pH Adjusting Agents

It was discovered that with the inventive electroless plating composition, one embodiment allows for a lower-end pH range to be used. Various pH-adjusting compositions may be used including organic and inorganic bases. That a compound is basic can be easily confirmed by dipping pH test paper, measuring its aqueous solution using a pH meter, observing the discoloration caused by an indicator or measuring the adsorption of carbonic acid gas, and by other methods.

In one embodiment, the organic base compounds which can be used include organic amines such as pyridine, pyrrolidine, combinations thereof, and the like. Other embodiments include methylamine, dimethylamine, trimethylamine, combinations thereof, and the like. Other embodiments include ethylamine, diethylamine, triethylamine, combinations thereof, and the like. Other embodiments include tetramethylammonium hydroxide (TMAH), tetraethyl ammonium hydroxide (TEAH), tetrapropyl ammonium hydroxide (TPAH), tetrabutyl ammonium hydroxide (TBAH), combinations thereof, and the like. Other embodiments include aniline, toluidine, and the like.

In one embodiment, the organic base includes TMAH in a concentration range from about 30 mL to about 150 mL, added to a 100 mL volume of the other constituents of the inventive electroless plating solution. Other embodiments include the gram equivalent amounts of the organic base compounds set forth herein.

In one embodiment, the inorganic base compounds which can be used are salts of strong bases and weak acids. In one embodiment, alkali metal acetates, alkaline earth metal acetates, and combinations thereof are used. In one embodiment, alkali metal propionates, alkaline earth metal propionates, and combinations thereof are used. In one embodiment, alkali metal carbonates, alkaline earth metal carbonates, and combinations thereof are used. In one embodiment, alkali metal hydroxides, alkaline earth metal hydroxides, and combinations thereof are used. In one embodiment, combinations of at least two of the acetates, propionates, carbonates, and hydroxides is used.

Inorganic base compounds may be provided in a concentration such as a 25% NaOH in DI water solution, to make a volume of about 10 mL to about 50 mL. This volume of solution is added to an about 100 mL volume of the other inventive electroless plating composition constituents. Other embodiments include the gram equivalent amounts of the inorganic base compounds set forth herein.

Other compounds may be added to the inventive electroless plating composition such as surface active agents. One commercial surfactant is RHODAFAC RE 610, made by Aventis (formerly Rhone-Poulenc Hoechst). Another commercial surfactant is Triton x-100T™ made by Sigma-Aldrich. Other surfactants include cystine, polyethylene glycols, polypropylene glycol (PPG)/polyethylene glycol (PEG) (in a molecular range of approximately 200 to 10,000) in a concentration range of about 0.01 to 5 gram/liter, and the like.

Several combinations of primary and secondary metals are achievable according to various embodiments. The primary metal may include, but is not limited to from one to nine metals, selected from copper, silver, gold, nickel, palladium, platinum, cobalt, rhodium, and iridium. The secondary metal may include, but is not limited to from zero to six metals selected from chromium, molybdenum, tungsten, manganese, technetium, and rhenium. In one embodiment, because of the presence of the primary and optional secondary reducing agents, a metallic compound forms that incorporates boron and optionally phosphorus.

In one embodiment, nickel is a primary metal for an electroless plating embodiment, the composition includes a nickel solution to form a nickel plating layer. According to an embodiment, where nickel is the primary metal, because of the inventive electroless plating bath environment, metallic films form that include but are not limited by such combinations as NiB, NiBP, NiCrB, NiCrBP, NiMoB, NiMoBP, NiWB, NiWBP, NiMnB, NiMnBP, NiTcB, NiTcBP, NiReB, and NiReBP. Where two primary metals are used in solution, the inventive electroless plating bath environment may form metallic films that include but not are limited by such combinations as to NiCoB, NiCoBP, NiCoCrB, NiCoCrBP, NiCoMoB, NiCoMoBP, NiCoWB, NiCoWBP, NiCoMnB, NiCoMnBP, NiCoTcB, NiCoTcBP, NiCoReB, and NiCoReBP. It can be seen that at least two—to nine primary metals and from zero to at least one secondary metals are combinable according to various embodiments. In similar embodiments, palladiumn can be used in place of—or in addition to nickel. Similarly, platinum can be used in place of—or in addition to nickel. Additionally, a blend of at least two of nickel, palladium, and platinum can be used as set forth herein.

In another embodiment, cobalt is a primary metal for an electroless plating embodiment, the composition includes a cobalt solution to form a cobalt plating layer. According to an embodiment, where cobalt is the primary metal, because of the inventive electroless plating bath environment, metallic films form that include but are not limited by such combinations as CoB, CoBP, CoCrB, CoCrBP, CoMoB, CoMoBP, CoWB, CoWBP, CoMnB, CoMnBP, CoTcB, CoTcBP, CoReB, and CoReBP. Where two primary metals are used in solution, the inventive electroless plating bath environment may form metallic films that include but not are limited by such combinations as to NiCoB, CoPdBP, CoPdCrB, CoPdCrBP, CoPdMoB, CoPdMoBP, CoPdWB, CoPdWBP, CoPdMnB, CoPdMnBP, CoPdTcB, CoPdTcBP, CoPdReB, and CoPdReBP.

It can be seen that at least two—to nine primary metals and from zero to at least one secondary metals are combinable according to various embodiments. In similar embodiments, rhodium can be used in place of—or in addition to cobalt. Similarly, iridium can be used in place of—or in addition to cobalt. Additionally, a blend of at least two of cobalt, rhodium, and iridium can be used as set forth herein.

Where, by way of non-limiting example, copper is a primary metal for an electroless plating embodiment. The composition includes a copper solution to form a copper plating layer. According to an embodiment, where copper is the primary metal, because of the inventive electroless plating bath environment, metallic films form that include but are not limited by such combinations as CuB, CuBP, CuCrB, CuCrBP, CuMoB, CuMoBP, CuWB, CuWBP, CuMnB, CuMnBP, CuTcB, CuTcBP, CuReB, and CuReBP. Where two primary metals are used in solution, the inventive electroless plating bath environment may form metallic films that include but not are limited by such combinations as to CuNiB, CuNiBP, CuNiCrB, CuNiCrBP, CuNiMoB, CuNiMoBP, CuNiWB, CuNiWBP, CuNiMnB, CuNiMnBP, CuNiTcB, CuNiTcBP, CuNiReB, and CuNiReBP. It can be seen that at least two—to nine primary metals and from zero to at least one secondary metal is combinable according to various embodiments. In similar embodiments, silver can be used in place of—or in addition to copper. Similarly, gold can be used in place of—or in addition to copper. Additionally, a blend of at least two of copper, silver, and gold can be used as set forth herein.

In summary as to the primary and secondary metals and the primary and secondary reducing agents that result in electrolessly plated film, the electrolessly plated film may be represented by the formula $$pM_w sM_x B_y P_z$$

wherein pM represents but is not limited to from one to nine of the primary metals, sM represents but is not limited to from zero to six of the secondary metals, B represents the amount of boron in the electrolessly plated film, and P represents the amount of phosphorus in the electrolessly plated film. Further, w has a range from about 0.5 to about 0.99, x has a range from about 0.0 to about 0.2, y has a range from about 0.01 to about 0.1, and z has a range from about 0.0 to about 0.02.

Figure 2:
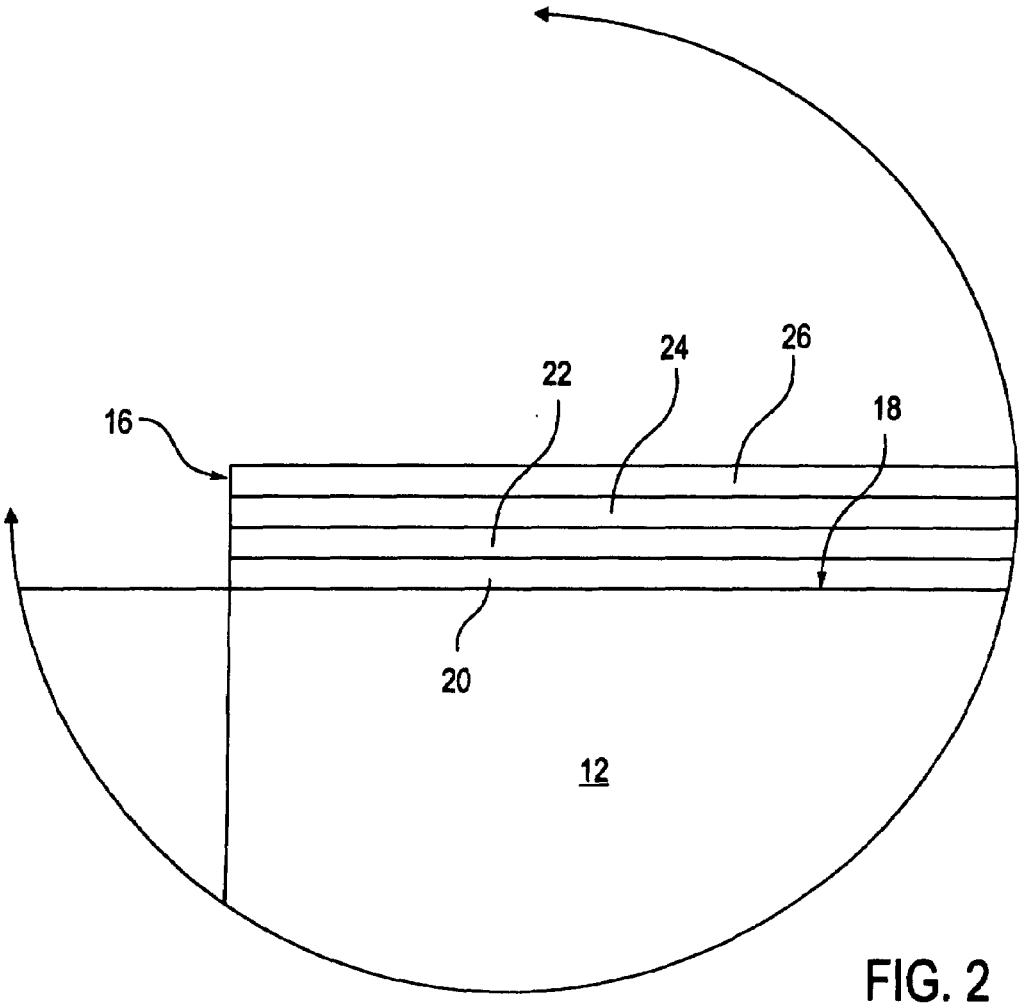
FIG. 2 is an elevational cross-section of a section taken from the semiconductor structure depicted in FIG. 1 that illustrates plated lamellae in arbitrary divisions.

FIG. 2 is an elevational cross-section of a section of semiconductor structure 10, taken along the section line 2-2. It is noted that an arbitrary arrangement and number of lamellae 20, 22, 24, and 26 are depicted. The lamellae 20, 22, 24, and 26 are defined as regions of different average chemical makeup, and not necessarily as separate structural bodies. Quantification of the lamellar compositions within metal film 16 may be done by CMP to a given depth and by qualitative and quantitative analysis such as X-ray diffraction (XRD), scanning electron microscopy (SEM) or others. It is noted that the deposition dynamic of a deposition substrate that is changing, in one embodiment from a copper substrate to a cobalt substrate, the primary reducing agent is assisted increasingly by the secondary reducing agent such that a virtually phosphorus-free CoB first lamella 20 is detectable at the copper-cobalt interface that is at upper surface 18 of metallization 12. However, an increasing phosphorus gradient is detectable at a second lamella 22 disposed above the virtually phosphorus-free CoB first lamella 20. FIG. 2 also depicts two more arbitrary lamellae as an intermediate lamella 24, and an upper lamella 26. It is noted that the concentration phosphorus in upper lamella 26 is greater than the concentration of phosphorus in second lamella 22.

According to these embodiments, the primary metals are plated, and the secondary metals are co plated. By this it is meant that in some embodiments, co plated metals precipitate in environments that, without the presence and plating chemistry of the primary metal(s) the co plated metals are less likely to precipitate.

It in one example, more than two primary metals are added to the inventive electroless plating solution, and more than one secondary metal is also added. In one embodiment, a primary metal(s) is provided in a total concentration range from about 5 gram/liter to about 50 gram/liter, and a secondary metal(s) is provided in a total concentration range from about 1 gram/liter to about 30 gram/liter. In one exemplary embodiment, cobalt is provided in a range from about 5 gram/liter to about 35 gram/liter, and tungsten is provided in a range from about 1 gram/liter to about 30 gram/liter.

Other embodiments include the combination of primary metals (referred to hereinafter as M) in various combinations. Thus M may be a compound selected from copper-silver, copper-gold, copper-silver-gold, and the like. Other M compounds are selected from nickel-palladium, nickel-platinum, nickel-palladium-platinum, and the like. Other M compounds are selected from cobalt-rhodium, cobalt-iridium, cobalt-rhodium-iridium, and the like. Other M compounds that cross over into the above groups are selected from cobalt-nickel, cobalt-nickel-silver, cobalt-nickel-silver-copper, cobalt-silver, cobalt-silver-copper, cobalt-copper, cobalt-copper-nickel, nickel-silver, nickel-silver-copper, nickel-copper, silver-copper, and others. To any of these combinations, at least one of the secondary metals boron may be added as set forth above.

In the following embodiments, it is noted that cobalt is set forth as the primary metal. However, it is understood that any of the aforementioned metals or metal combinations are embodiments. As set forth herein, in addition to a metal ion(s) in solution, the inventive plating solution includes a pH-adjusting agent, a complexing/buffering agent to maintain the cobalt in solution, at least one reducing agent, and optionally a wetting agent. In one embodiment, the cobalt ion is a cobalt halide such as cobalt fluoride, cobalt chloride, cobalt bromide, cobalt iodide, mixtures thereof, and the like. In other embodiments, the primary and secondary metals are supplied in solutions that are commercially obtainable such as copper sulphate, silver chloride, nickel chloride, and the like.

Another embodiment of the present invention relates to an inventive process flow. By way of non-limiting example, cobalt is used to demonstrate the inventive process flow. A technique of electrolessly depositing a cobalt film is described. Furthermore, although one embodiment is described in reference to cobalt deposition, it is appreciated that the cobalt deposition described is for exemplary purposes only and that the technique of this embodiment can be adapted to other types of materials, including other metals and alloys.

Figure 3:
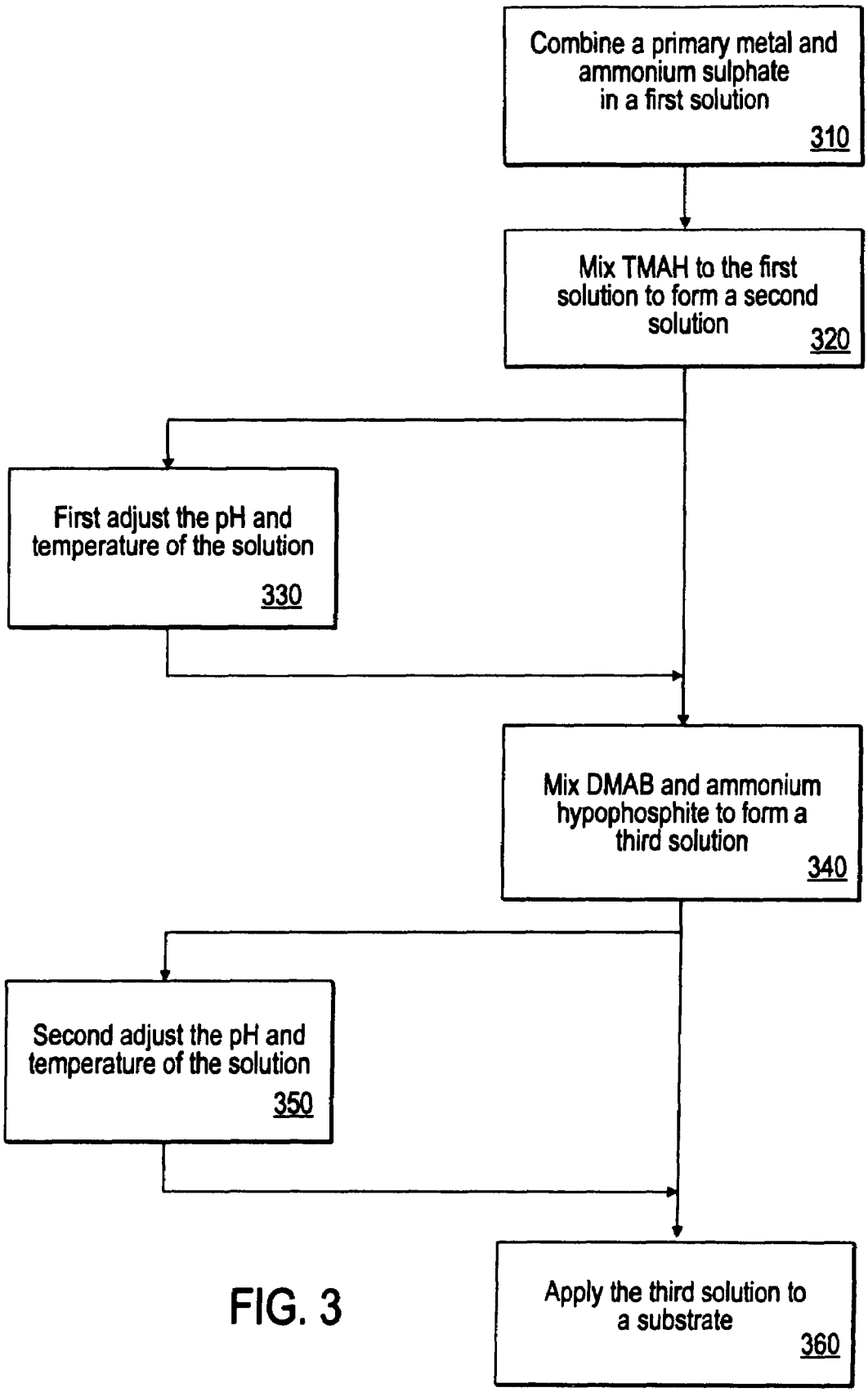
FIG. 3 illustrates an inventive process flow embodiment.

FIG. 3 illustrates a process flow embodiment of the present invention. Initially, a primary metal and complexing/buffer agent such as ammonium sulphate is combined 310 in a first solution. Where opted for, a secondary metal is combined into the first solution before further processing, although it may be added at other process flow paths. A pH-controlling substance such as TMAH is next added 320 to the first solution to make a second solution. Optionally, more pH adjustment may be carried out by first adjusting 330 the pH and additionally the temperature of the second solution in what may be referred to as a coarse pH- and temperature adjustment. After the second solution is at a preferred pH and temperature, at least one primary reducing agent, such as DMAB, and optionally a secondary reducing agent, such as ammonium hypophosphite are mixed 340 into the second solution to form a third solution. Optionally, further pH adjustment may be carried out by second adjusting 350 the pH and additionally the temperature of the third solution in what may be referred to as a fine pH- and temperature adjustment. Finally for this process flow embodiment, the third solution is applied 360 to a substrate such as metallization 12 under conditions to cause electroless deposition of the metal(s).

In order for cobalt to be electrolessly plated onto a surface of a conductive material the surface of the conductive material must be susceptible to the autocatalytic growth of cobalt. If the surface does not provide a nucleation environment, then the inventive solution needs to contain reducing agents that will cause cobalt nucleation at the surface.

Referring again to FIG. 1, the upper surface 18 of the metallization 12, which will receive the cobalt growth, is autocatalytic to cobalt deposition, or is assisted in receiving cobalt by assistance of the primary- and optionally the secondary reducing agents. Accordingly, the electroless plating of cobalt occurs. As noted above, the technique of electrolessly depositing a metal or a metal alloy is carried out, such as by immersing semiconductor structure 10 in a cobalt electroless plating solution, the solution is sprayed onto semiconductor structure 10 or by another technique.

In one embodiment, the surface of the metallization 12 on the semiconductor structure 10 is treated to improve the uniformity of the electroless plating film. The exposed conductive material 12 is surface treated with an agent such as a 1 to 20 percent by volume hydrofluoric acid (HF), sulfuric acid ($H_2SO_4$), sulfonic acids such as methanesulfonic acid (MSA) ethanesulfonic acid (ESA), propanesulfonic acid (PSA), benzene sulfonic acid (BSA), and the like.

Processing conditions may be varied by controlling the temperature, the pH of the solution, the plating time, and the concentration of the various constituents. In one embodiment, an electroless cobalt plating solution is maintained at a temperature range from about ambient- or room temperature (typically about 20-25° C.) and at a pH of 7-10. In one embodiment, a pH of 7 is used and a processing temperature of about 35° C. is used.

It is appreciated that a variety of electroless deposition conditions are used to electrolessly deposit the cobalt. The particular cobalt solution is comprised of about 5 gram/liter to about 35 gram/liter of cobalt chloride. A primary reducing agent includes DMAB in a concentration range from about 2 gram/liter to about 30 gram/liter. An optional secondary reducing agent includes ammonium hypophosphite in a concentration range from about 0 gram/liter to about 2 gram/liter. The complexing and buffering agent is $(NH_2)SO_4$ in a concentration range from about 80 gram/liter to about 600 gram/liter. The pH is adjusted by TMAH in a volume, that is added to about 100 mL of the other solution constituents, from about 30 mL to about 150 mL. The pH range is from about pH 7 to about pH 10. The temperature is maintained in a range from ambient (about 20° C.) to about 60° C. Additionally, and optionally, RHODAFAC# RE610 is added in de-ionized (DI) water.

The following is an example of an electroless plating process flow according to an embodiment. Initially, an optional seed layer is formed over a substrate. The optional seed layer may be formed, either by chemical vapor deposition (CVD) or by physical vapor deposition (PVD).

The example continues according to the inventive embodiments. Prior to placing the semiconductor structure into an inventive plating bath composition, it may be pre-cleaned by a pre-rinse such as with about 0-50 mL deionized (DI) water. Other pre-rinsing may be done such as by distilled water. Additionally, the pretreatment may optionally be a reducing process wherein a cathodic state is impressed upon the substrate such that oxidation at the substrate or at the optional seed layer is reversed. Other pretreatment may include organic and inorganic solvents, mineral and organic acids, strong and weak bases, and combinations of any of the above.

In one embodiment, the wafer is processed in a tool with seals to prevent exposure of the backside of the wafer to plating chemicals. A wafer holder holds the wafer with the device side face down or face up, which may reduce complications to the deposition due to gas evolution during the electroless plating process. The wafer may be temperature controlled by heating the wafer, heating the bath or a combination thereof. After processing, semiconductor substrate 10 is rinsed in deionized (DI) water.

In another example, a dispensed plating is used. In this process flow, chemicals are dispensed onto the device side of the wafer and the backside is protected from exposure. This configuration has the advantage of limiting the interaction between the reagents to tubing or other apparatus. Consequently, little or no depletion of the metal ions to be deposited occurs. In another embodiment, electroless plating is performed on a wafer scrubber. A wafer scrubber typically consists of cylindrical rotating pads which mechanically remove debris from both sides of the wafer.

Operating conditions according to present invention may be selected depending upon a particular application. The wafer may be contacted by the electroless plating bath solution by moving the bath solution in relation to the wafer. For example, the wafer may be rotated. A preferred rotation speed is in the range from about 0 to about 500 rpm. Optionally, the bath solution may be rotated and the wafer held in place. This embodiment allows for the elimination of moving parts in a wafer electroplating chamber with the advantage of reducing the likelihood of particulates contaminating the electroplating bath solution.

In one process flow embodiment, a plating tool containing about 1-25 plating chambers is loaded with between and one and 25 wafers and the inventive electroless plating bath solution is flowed at a rate from about 3 L/min to about 60 L/min for each wafer. Where the wafer is rotated, or the solution is rotated, the wafer rotation speed, relative to the solution, is between 0 rpm and about 500 rpm.

In a first paper example, the primary metal is supplied as cobalt chloride in a cobalt-ion concentration range from about 5 gram/liter to about 35 gram/liter. The primary reducing agent is supplied as DMAB in a concentration range from about 2 gram/liter to about 20 gram/liter. The secondary reducing agent(s) is ammonium hypophosphite, supplied in a concentration range from about 0 gram/liter to about 2 gram/liter. The complexing/buffering agent is $(NH)_2SO_4$, supplied in a concentration range from about 80 gram/liter to about 600 gram/liter. pH is adjusted by TMAH in a concentration range from about 30 mL to about 150 mL, added to a 100 mL volume of the other constituents of the inventive electroless plating composition. Additionally, surface tension of the solution is adjusted by RHODAFAC RE 610 in a concentration range of about 0.01 gram/liter to about 5 gram/liter. The process flow follows the flow scheme that is generally depicted in FIG. 3. According to this embodiment, the deposition rate of electroless cobalt is about 35 nanometers (nm)/min. Average surface roughness (Ra) is about 4 nm for a 150-200 nm-thick electrolessly plated cobalt film. Resistivity of the electrolessly plated cobalt film is about 28-32 μΩcm.

In a second paper example, all the conditions of the first example are included with the variation in the result that the primary metal and the boron-containing primary reducing agent result in a metal film 16 that has a concentration of about 90% cobalt and about 10% boron.

In a third paper example, illustrated in FIG. 2, all the conditions of the first example are included with the variation in the result that the effect of both DMAB and ammonium hypophosphite are noted in the several lamellae 20, 22, 24, and 26 of a CoBP metal film 16 that has an increasing phosphorus concentration as metal film 16 is formed.

The amount of reducing agent and complexing/buffering agent are dependent upon the amount of the primary and any secondary metal ions in the inventive solution. In one embodiment, the amount of the primary metal(s) is about 50-99%, the amount of the secondary metal(s) is about 1-40%, the amount of boron (from the primary reducing agent) is about 0.1-20%, and the amount of phosphorus (from the secondary reducing agent) is about 0-5%. For example, in a CoW electrolessly plated film (that includes boron and optionally phosphorus), the tungsten is present in a range from about 2% to about 7%. The tungsten, or other secondary metal(s), improves the barrier properties by filling in the grain boundaries of the crystalline structure of the CoB film with tungsten atoms. Because copper corrosion typically proceeds by copper diffusing through larger-than-copper-atom pores in a copper rust, the secondary metal(s) act to fill the grain boundaries that, without their presence, allows copper atoms to more easily diffuse through the CoB grain boundaries. However, by having the tungsten present, the tungsten atoms will prevent copper diffusion along the CoB grain boundaries.

It will be readily understood to those skilled in the art that various other changes in the details, material, and arrangements of the parts and method stages which have been described and illustrated in order to explain the nature of this invention may be made without departing from the principles and scope of the invention as expressed in the subjoined claims.

What is claimed is:

1. An electroless plating structure on a copper pad, having a composition comprising:

$pM_wsM_xB_yP_z$ wherein pM is a primary metal consisting of at least one element selected from the group consisting of Cu, Ag, and Au;

wherein sM is a secondary metal consisting of at least one element selected from the group consisting of Cr, Mo, W, Mn, Tc, and Re;

wherein B and P represent boron and phosphorus, respectively; and wherein w has a range from about 0.5 to about 0.99, x has a range from 0.0 to about 0.2, y has a range from about 0.01 to about 0.1, and z has a range from 0.0 to about 0.02.

2. An electroless plating structure on a copper pad, having a composition comprising:

$pM_wsM_xB_yP_z$ wherein pM is a primary metal consisting of at least one element selected from the group consisting of Cu, Ag, Au, Pd, Pt. Ni, Rh, and Ir;

wherein sM is a secondary metal consisting of at least one element selected from the group consisting of Cr, Mo, W, Mn, Tc, and Re;

wherein B and P represent boron and phosphorus, respectively; and wherein w has a range from about 0.05 to about 0.99, x has a range from a value approaching but not equal to 0.0 to about 0.02, y has a range from about 0.01 to about 0.1, and z has a range from 0.0 to about 0.02.

3. The electroless plating structure according to claim 2, wherein pM is a primary metal consisting of at least one element selected from the group consisting of Ni, Pd, and Pt.

4. An electroless plating structure on a copper pad, having a composition comprising:

$pM_wsM_xB_yP_z$ wherein pM is a primary metal consisting of at least one element selected from the group consisting of Rh and Ir;

wherein sM is a secondary metal consisting of at least one element selected from the group consisting of Cr, Mo, W, Mn, Tc, and Re;

wherein B and P represent boron and phosphorus, respectively; and wherein w has a range from about 0.5 to about 0.99, x has a range from 0.0 to about 0.2, y has a range from about 0.01 to about 0.1, and z has a range from 0.0 to about 0.02.

5. An electroless plating structure on a copper pad, having a composition comprising:

$pM_wsM_xB_yP_z$ wherein pM is a primary metal consisting of at least one element selected from the group consisting of Cu, Ag, Au, Pd, Pt, Ni, Rh, and Ir;

wherein sM is a secondary metal consisting of at least one element selected from the group consisting of Cr, Mo, W, Mn, Tc, and Re;

wherein B and P represent boron and phosphorus, respectively; and wherein w has a range from about 0.5 to about 0.99, x has a range from 0.0 to about 0.2, y has a range from about 0.01 to about 0.1, and z has a range from a value approaching but not equal to 0.0 to about 0.02.

6. The electroless plating structure according to claim 5, wherein x has a range from a value approaching but not equal to 0.0 to about 0.02.

7. The electroless plating structure according to claim 5, wherein pM is a primary metal consisting of at least one element selected from the group consisting of Rh and Ir.

8. An electroless plating structure on a copper pad, having a composition comprising:

$Co_wsM_xB_yP_z$ wherein sM is a secondary metal consisting of at least one element selected from the group consisting of Cr, Mo, W, Mn, Tc, and Re;

wherein Co, B, and P represent cobalt, boron, and phosphorus, respectively; and wherein w has a range from about 0.5 to about 0.99, x has a range from 0.0 to about 0.2, y has a range from about 0.01 to about 0.1, and z has a range from a value approaching but not equal to 0.0 to about 0.02.

9. The electroless plating structure of claim 8 wherein x has a range from a value approaching but not equal to 0.0 to about 0.02.

* * * * *

UNITED STATES PATENT AND TRADEMARK OFFICE

CERTIFICATE OF CORRECTION

PATENT NO. : 7,279,231 B2
APPLICATION NO. : 10/649087
DATED : October 9, 2007
INVENTOR(S) : Chebiam et al.

It is certified that error appears in the above-identified patent and that said Letters Patent is hereby corrected as shown below:

Column 11, at line 25, delete “Pt.” and insert --Pt,--.

Column 11, at line 31, delete “0.05” and insert --0.5--.

Signed and Sealed this

Twentieth Day of May, 2008

JON W. DUDAS
*Director of the United States Patent and Trademark Office*